US006010091A

United States Patent [19]

Leskinen et al.

[11] Patent Number: 6,010,091

[45] Date of Patent: Jan. 4, 2000

[54] METHOD AND DEVICE FOR THREADING A PAPER WEB THROUGH A WINDING MACHINE

[75] Inventors: Arto Leskinen, Nukari; Jari Sinkko, Järvenpää ; Pauli Koutonen, Jokela, all of Finland

[73] Assignee: Valmet Corporation, Helsinki, Finland

[21] Appl. No.: 08/887,015

[22] Filed: Jul. 2, 1997

[30] Foreign Application Priority Data

Jul. 5, 1996 [FI] Finland ..... 962763

[51] Int. Cl.[7] ..... B65H 19/28; B65H 35/02

[52] U.S. Cl. ..... 242/532.7; 242/525; 242/562.1

[58] Field of Search ..... 242/525, 532.7, 242/562.1, 332.4; 226/92

[56] References Cited

U.S. PATENT DOCUMENTS

| | | | |
|---|---|---|---|
| 4,075,747 | 2/1978 | Hagne et al. | 242/532.7 |
| 4,138,074 | 2/1979 | Ross et al. | 242/532.7 |
| 4,605,179 | 8/1986 | Arbter | 242/532.5 |
| 5,094,394 | 3/1992 | Saukkonen | 242/532.7 |
| 5,152,471 | 10/1992 | Goerner | 242/56.4 |

FOREIGN PATENT DOCUMENTS

| | | |
|---|---|---|
| 91629 | 5/1989 | Finland . |
| 2164635 | 3/1986 | United Kingdom . |
| 2287242 | 9/1995 | United Kingdom . |

*Primary Examiner*—John Q. Nguyen
*Attorney, Agent, or Firm*—Steinberg & Raskin, P.C.

[57] ABSTRACT

A method and device for winding a paper web in which the paper web is unwound from a paper reel, the end of the paper web is taken as a substantially full width from the reel and attached to a threading member which extends substantially over the entire length in the cross direction of the web. The threading member carries the end of the paper web through the winding machine so that the web is carried with a substantially uniform tension. The threading member is carried by draw fabrics placed in the cross direction in the area of the web.

18 Claims, 5 Drawing Sheets

10
11
12
16
17
18
19
30
40
57
58
62
W
W,62
120

METHOD AND DEVICE FOR THREADING A PAPER WEB THROUGH A WINDING MACHINE

FIELD OF THE INVENTION

The present invention relates to a method for winding of a paper web in which the paper web is unwound from a paper reel and partitioned, and then the partitioned web components are wound onto roll spools.

The present invention also relates to a winding device for winding a paper web or equivalent including an unwind stand in which a reel of a paper web is unwound and a paper web threading member for threading the paper web through the winding device.

The present invention also relates to an arrangement for unwinding a paper web in which a paper reel is unwound as a paper web of full width and passed to a slitter-winder. In the slitter-winder, the paper web is slit into narrower component webs, which are subsequently wound into component rolls. The invention is in particular related to a slitter-winder of the bottom draw center-drive winder type. However, the invention is also suitable for use in connection with slitter-winders of other types.

BACKGROUND OF THE INVENTION

In the prior art, constructions are known in which, in the tail threading in web slitters, devices are used which are based on various blowings and suctions. It has been noticed though that such blowing and/or suction devices are not sufficiently reliable for taking the leader end of the web of fill width from the paper reel and for passing the web of full width from the unwind station to the slitter.

At present, in paper mills, of the various stages of processing, attempts are made to eliminate those stages that require an abundance of manual operations. One problematic stage is the tail threading stage, which often requires the work of several persons and is required in connection with finishing devices, winders, cutters, etc. Also, in paper machines, high running speeds are sought, in which case, in a paper finishing device, the web threading must take place as quickly and reliably as possible.

In the prior art, constructions are known in which the threading of the paper web through a finishing device has been accomplished while the web has a full width, but the control of the web tension during the tail threading has proved problematic. The tension of the web has an important effect on a successful threading, for the following reasons:

- Sufficient tension alone can guarantee a successful slitting during threading.
- Uneven tension has the consequence that the web is torn at tension peaks or that the overall tension must be kept very low, in which connection a part of the web remains even non-tensioned, i.e., slack.
- A slack web portion may enter into contact with structures placed near the winding path, in which connection the web can be torn.
- Adequate tension facilitates the formation of a good roll bottom at the beginning of winding.

In the prior art, constructions are also known in which a web of full width is attached from its edges and passed from the unwind station to the slitter. In one commonly used construction, it has proved to be a problem that the web tends to be torn because a highly uneven tension is formed in the web.

With respect to the prior art, reference is made to Finnish Patent 91,629 which describes a reel slitter whose function is to slit a web of paper machine width in the longitudinal direction in a slitting or cutting station. In the arrangement known from this patent, a pull-in bar is used which can be passed through the machine by means of a chain and to which the initial end of the web can be attached. This prior art reel slitter comprises two support drums, on whose support the webs are wound. The pull-in device provided with a pull-in bar feeds the component webs onto a first one of the support drums. Further, a transfer device, which receives the non-adjacent component webs after their separation from the pull-in bars, feeds the webs by means of a suction tube onto a second one of the support drums. It is one of the drawbacks of this prior art construction that, since the threading bar is pulled from its ends, during bending it produces an uneven distribution of tension in the web (compare FIG. 5A), from which it follows, among other things, that the web can be readily torn at the edges where the tension is high. Owing to the risk of tearing, the threading must be carried out with a very low overall web tension, and thus, in the direct beginning of winding, the desired web tension cannot be achieved. Furthermore, a slitting during threading can tear the web because of the low tension.

It is a further problem in this prior art construction that the web tension measurement devices of the slitter-winder cannot be used until the threading bar has by-passed the web guide roll which measures the tension of the web. In this construction, the fastening of the web to the threading bar is carried out manually. As such, aligning the leader end of the web on the threading member in the longitudinal direction of the slitter-winder so that the end of the web is exactly at the same location as the web is difficult during winding and inaccurate, i.e., it is difficult to place the ends of the component webs on the winding drums in the correct locations in the axial direction of the winding drums.

OBJECTS AND SUMMARY OF THE INVENTION

It is an object of the present invention to provide a new and improved winding method and device which achieves threading of a web of full width into the winding device, which threading operates reliably and requires the work of only one person.

It is another object of the present invention to provide an improved arrangement by whose means the leader end of the web can be threaded having a full width in connection with a slitter-winder of the center-drive winder type.

It is a further object of the invention to provide a method and device for threading a web having a full width in which the web tension during threading is controlled and substantially uniform.

It is still another object of the invention to provide an arrangement by whose means the tension of the web can be measured and controlled during threading so that the component webs have the correct tension immediately at the beginning of rewinding into component rolls.

In view of achieving the objects stated above and others, in the method in accordance with the invention, the end of the paper web is taken having a substantially full width from the paper reel and is attached to a threading member which extends substantially over the entire length in the cross direction of the web. The threading member carries the end of the paper web through a winding machine so that the web is carried having a substantially uniform tension. The threading member is carried by one or more draw fabrics placed in the cross direction in the area of the web and which are guided through the winding device to thereby thread the web into the winding device.

In the device in accordance with the invention, the full-width end of the paper web is attached, for the time of threading, to a threading member extending substantially over the entire length in the cross direction of the paper web. The threading member is arranged to be displaced by means of one or more draw fabrics.

The threading of the web in accordance with the invention is performed while the web has a full width and requires the work of only one person. In the arrangement in accordance with the invention, the tension of the web is controlled and uniform, in which connection the threading of the web can be carried out with the web tension corresponding to the start of the rewinding without involving any particular risk of tearing of the web. According to a preferred exemplifying embodiment of the invention, the web tension can also be regulated as feedback regulation immediately from the beginning of the threading while making use of the devices for measurement of tension during running operation of the slitter-winder. In this embodiment, separate tension measurement devices are not needed for the threading.

According to another preferred exemplifying embodiment of the method in accordance with the present invention, the leader end of the web of full width is taken from the unwind stand of a winding apparatus by means of a suction roll or equivalent. The web is pushed into the attachments in the threading bar by means of a press member, and the web is cut off. After the web has been attached to the threading bar, the threading bar starts carrying the web through the machine from the unwind station to the slitter-winder. The threading bar is attached to one or more draw fabrics arranged in the cross direction of the web, which fabrics are, from one end, fixed to a shaft provided with a drive gear and arranged in the winding device of the slitter-winder. The draw fabrics are wound onto the shaft, in which connection the draw fabrics pull the threading bar and the web end attached to it through the machine.

The threading equipment is provided with a drive gear, whose speed and/or pulling power may be regulated continuously and in a desired manner during the different stages of threading (for example by means of an inverter). The proceeding of the threading and its various stages are monitored and identified by means of various detectors, such as limit switches, tension detectors, and photocells. Based on the information provided by the detectors, the threading speed and the tension are controlled as a continuous sequence from the beginning to the end.

In one embodiment of the method for threading a paper web through a winding machine in accordance with the invention, the web is unwound from a paper reel and a forward end of the web is attached to a threading member which extends over substantially the entire width of the web. At least one draw fabric is coupled to the threading member such that the draw fabric(s) is situated at least partially between lateral edges of the web, i.e., in an area in correspondence with the web. The web is then carried through the winding machine while maintaining a substantially uniform tension across the width of the web by guiding the draw fabric(s) and thus the threading member through the winding machine while the web is attached to the threading member. The threading member may be an elongate threading bar whereby the draw fabrics are arranged substantially over the entire length of the threading bar so that the threading bar remains substantially straight in the winding direction. The draw fabric(s) is/are drawn in a path through the winding machine by attaching an end thereof to a winding shaft about which the draw fabric(s) is wound and rotating the winding shaft by means of a drive gear. The tension of the web is controlled by unwinding the web from the paper reel at a substantially constant speed and regulating the drive gear to control the rotation of the winding shaft. Also, it is possible to measure the tension of the web and regulating the drive gear to control the rotation of winding shaft by means of a logic system in compliance with a target tension value and the measured tension of the web. The location at which the draw fabric(s) is/are coupled to the threading member may be selected in order to maintain the substantially uniform tension across the width of the web during carrying of the web through the winding machine.

One embodiment of the winding device for winding a paper web in accordance with the invention includes a threading member extending substantially over the entire width of the web, an initial end of the web being attached to the threading member during threading of the web through the winding device, and at least one draw fabric connected to the threading member. The draw fabric(s) is/are directed through the winding device such that the threading member and the web attached thereto are guided through the winding device. The device may include fastening means for attaching the initial end of the web to the threading member, e.g., a press-member for attaching the initial end of the web to the threading member at a location apart from an initial edge of the web and a blade for cutting off a portion of the web between the location at which the web is attached to the threading member and the initial edge of the web. The threading member is carried to a winding part at a conclusion of the guiding of the threading member through the winding device in which case, the device include transfer means for transferring the threading member from the winding part to the unwind stand into a position to receive the initial end of the web for subsequent winding.

In one particular embodiment, the winding device include a guide roll over which the paper web is drawn, a suction roll movable between a first position in which it engages the paper reel and receives an initial edge of the web and a second position in which the paper web engages the guide roll, and fastening means for attaching the initial end of the web to the threading member while the suction roll is in the second position. The fastening means comprise cutting means for cutting the web between a location at which the initial end of the web is attached to the threading member and the initial edge of the web or, in the alternative, a press-member for attaching the initial end of the web to the threading member at a location apart from the initial edge of the web and a blade for cutting off a portion of the web between the location at which the web is attached to the threading member and the initial edge of the web.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
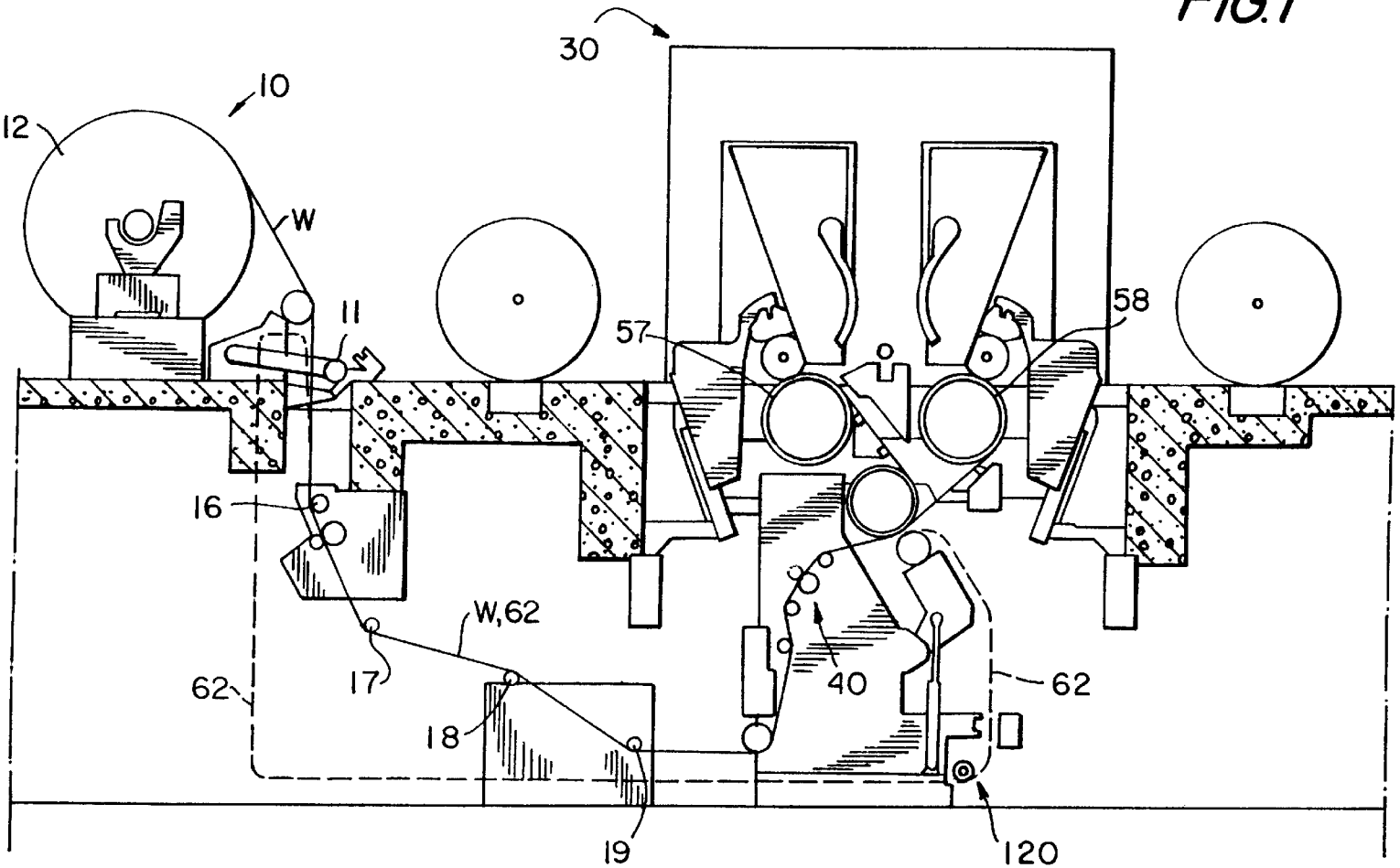
FIG. 1 is a schematic illustration of a slitter-winder of the bottom draw center drive winder type in accordance with the invention.

Referring to the accompanying drawings wherein like reference numerals refer to the same or similar elements, as shown in FIG. 1, the winder device in accordance with the invention comprises an unwind station 10 in which a paper reel 12 is unwound to provide a paper web W of full width. The web W is passed as a bottom draw into a slitter-winder 30 in which the web W is divided into component webs W' and wound into component rolls on roll spools, some in a first winding station by means of a winding drum 57 and others in a second winding station by means of a winding drum 58. More particularly, the winding device 30 comprises a slitter part 40, in which the web W is slit into the component webs W' in accordance with predefined settings.

The slitter-winder 30 is provided with means 120 for pulling the end of the web W of full width, which web end pulling means comprise a threading bar 21, draw fabrics 25 coupled to the threading bar 21, a winding shaft 32 for the draw fabrics 25 onto which the draw fabrics 25 are wound, and a shaft drive gear 32 for rotating the winding shaft for the draw fabrics 25 in order to pull the draw fabrics 25 along the winding path. The draw fabrics 25 of the threading bar 21 are, for example, made of fabric, plastic or rubber.

Figure 2:
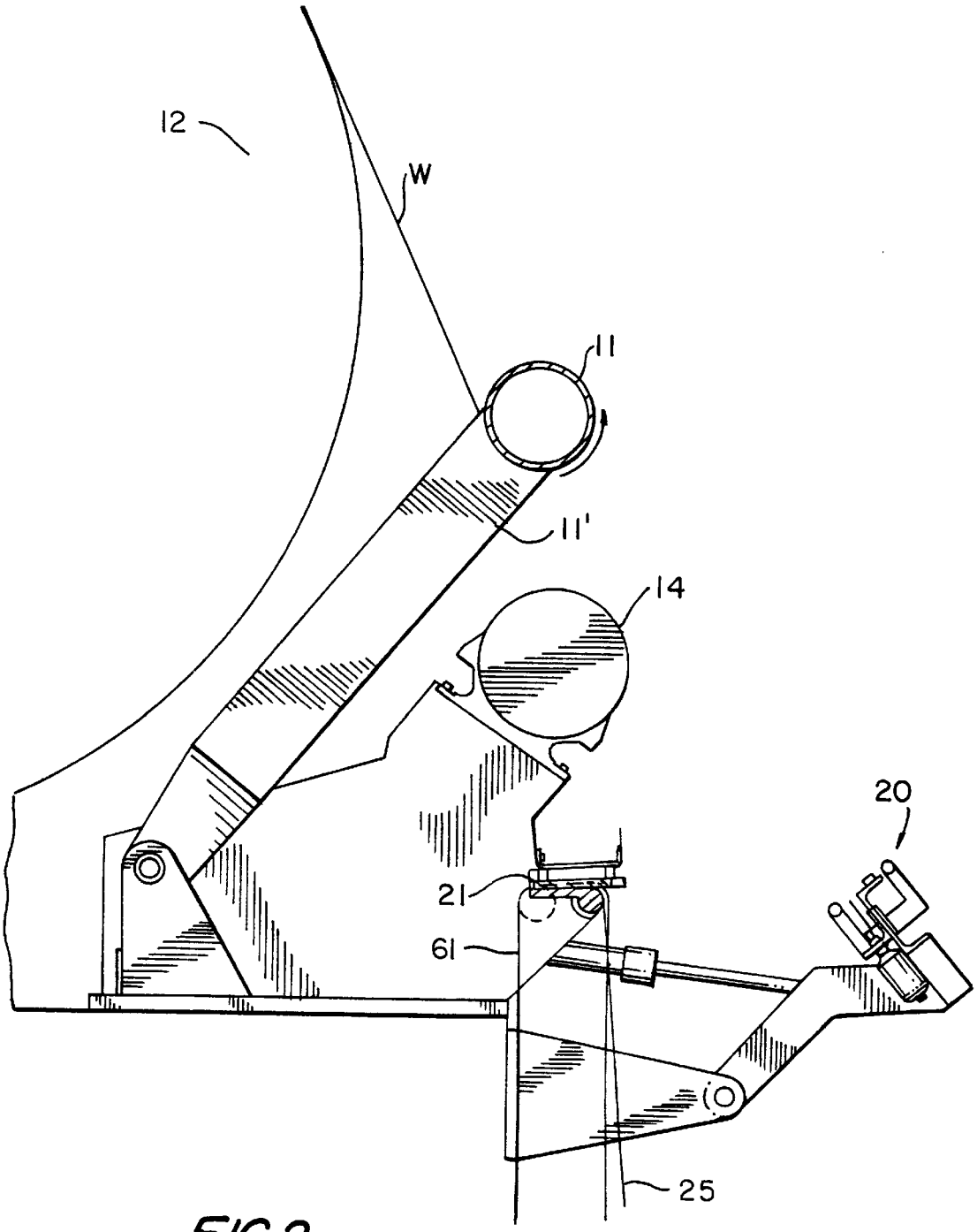
FIG. 2 is a schematic illustration of the initial stage of the threading of a web of full width, wherein the web is taken from the paper reel.

As shown in FIG. 2, in the unwind station 10 there is a paper reel 12 which is unwound to provide a paper web W of full width. In the stage shown in FIG. 2, the threading bar 21 has been brought to the unwind station 10, from its final position after the previous winding of the web, by means of chains 61 attached to the ends of the threading bar 21, which chains are driven by a separate drive gear. A chain track 62 (see also FIGS. 1 and 4) is arranged at the sides of the slitter-winder so that the threading bar runs along the same path as the web W does during winding, i.e., the draw fabrics 25 of the threading bar 21 are now on the web winding path and are drawn through the winding device along the winding path upon rotation of the winding shaft 32 of the draw fabrics by means of the drive gear 34. Further, in the stage shown in FIG. 2, the reel 12 revolves at a substantially constant speed, and the web W is taken apart from the reel 12 face by means of a suction roll 11, which has been transferred by means of arms 11' to a web receiving station.

Figure 3:
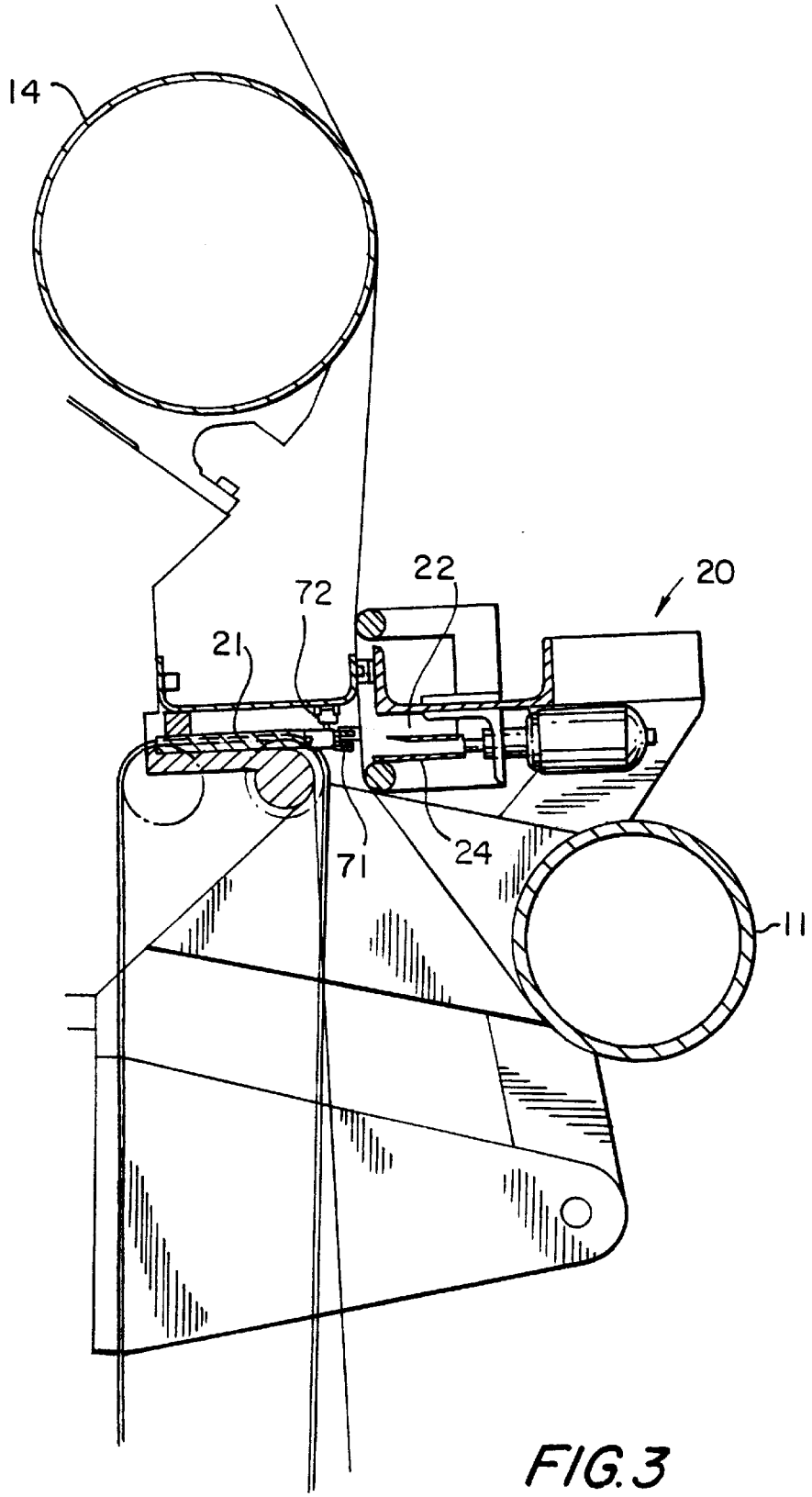
FIG. 3 is a schematic illustration of the stage of threading of a web of full width in which the web is passed to the threading members.

As shown in FIG. 3, the end of the web W is passed by means of the suction roll 11 over a guide roll 14 a certain distance so that web end fastening equipment 20 can press the web against the threading bar 21. In the web end fastening equipment 20, a press member 22 pushes the web W into an open clamp 71 in the threading bar 21, and cutting means such as a cutter blade 24 cut off the web. The clamp in the threading bar 21 is closed by a spring load, and it is opened by means of a separate actuator 72 provided on the frame of the guide roll 14. (In FIG. 3, the actuator 72 is a hose that expands pneumatically).

Figure 4:
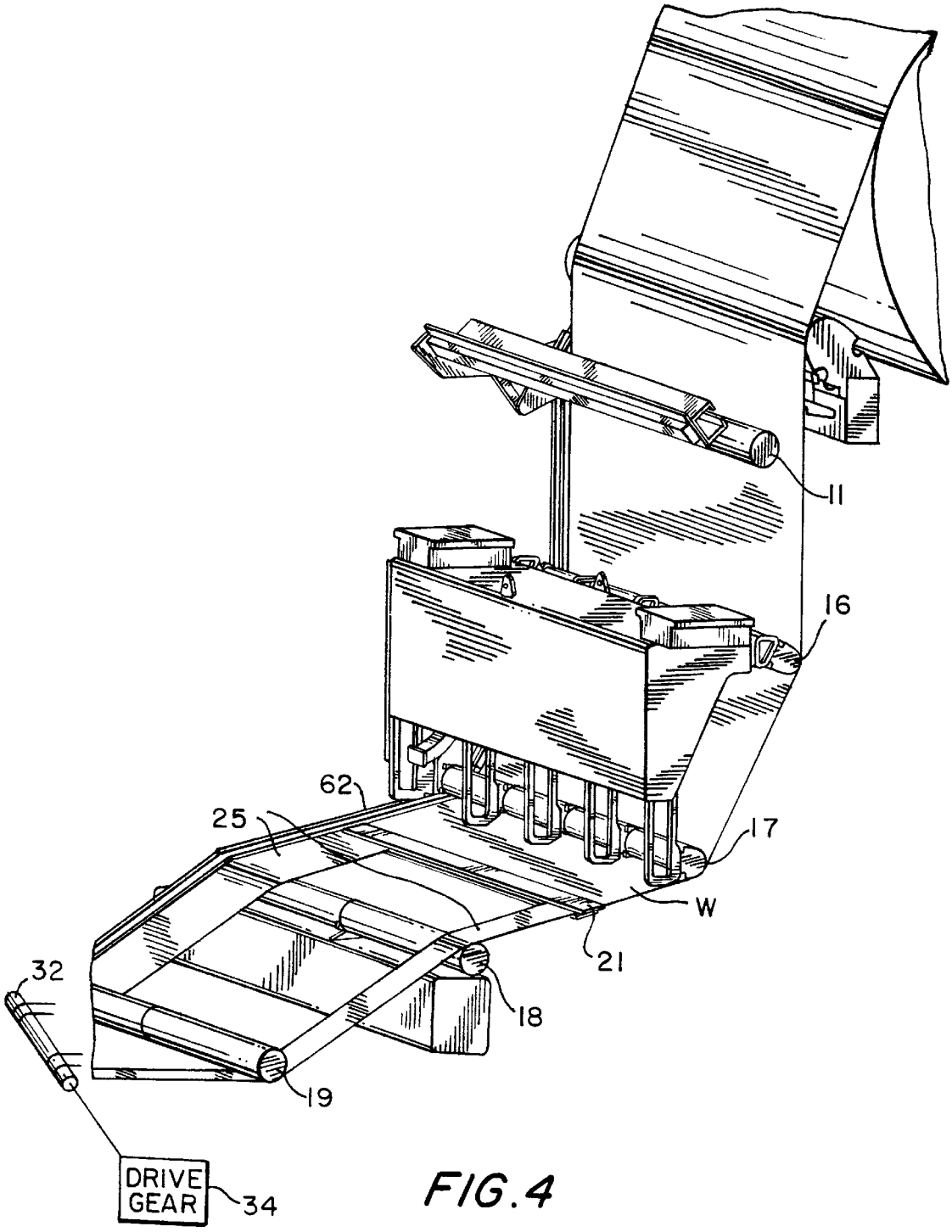
FIG. 4 is a schematic illustration of one end of the slitter-winder in accordance with the invention and a sectional view in the plane defined by the longitudinal and vertical directions of the machine in a situation in which the threading members carry the web of full width.

As shown in FIG. 4, after the web W has been attached to the threading bar 21 and cut off from the web portion adhering to the suction roll 11, the threading bar 21 starts carrying it through the machine. The threading bar 21 is transferred by means of draw fabrics 25 arranged in the cross direction of the web W. The threading bar 21 is passed over guide rolls 16,17,18,19 along the path along which the web runs during winding. By means of the draw fabrics 25, the threading bar 21 can be transferred through the winding device while remaining straight, in which case tension peaks, which would arise from bending of the threading bar 21, do not arise in the paper web thread in accordance with the invention (see FIGS. 5A and 5B discussed below). The draw tension is measured and controlled by means of the same known devices by whose means the web tension is measured and controlled during winding (for example, measurement of tension by means of force detectors arranged in bearing housings of one guide roll). The draw tension is formed so that the web W is unwound from the reel 12 at a substantially constant speed, and the tension is regulated by means of the drive gear of the draw fabrics 25, which drive gear is regulated in compliance with a target value and with the value given by the measurement of tension. The draw fabrics 25 are placed at least partially in the area of the web W so that they run in the longitudinal direction of the web W and, differing from the illustrated embodiment, there can be more than two fabrics in the cross direction of the web. As a draw fabric, it is also possible to use one draw fabric having a width substantially equal to the web width.

After the threading bar 21 has by-passed the slitter part 40, the longitudinal slitting of the web into component webs W' is started, which can now be accomplished successfully, because the web has a uniform, sufficiently high tension, and the ends of the component webs are finally passed onto the winding drums 57 and 58, and the winding proceeds in the manner shown in FIG. 1.

Figure 5A:
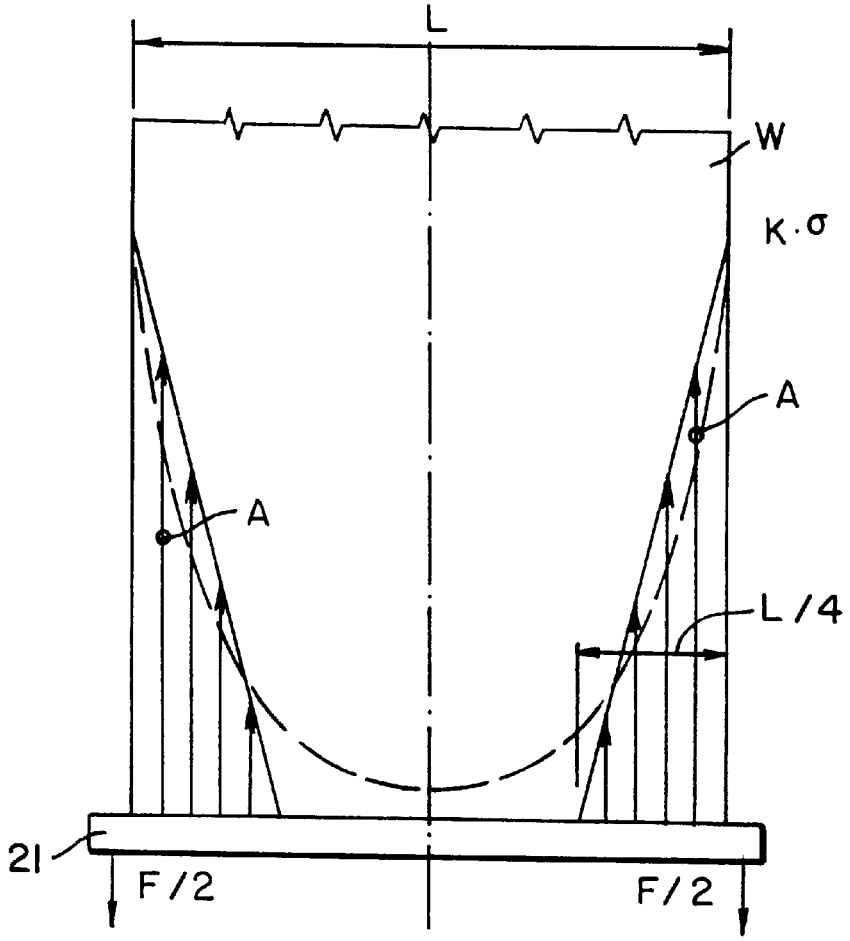
FIG. 5A PRIOR ART
FIG. 5A is a schematic illustration of the distribution of tension in a typical prior art construction in which the web of full width has been attached from its edges.
Figure 5B:
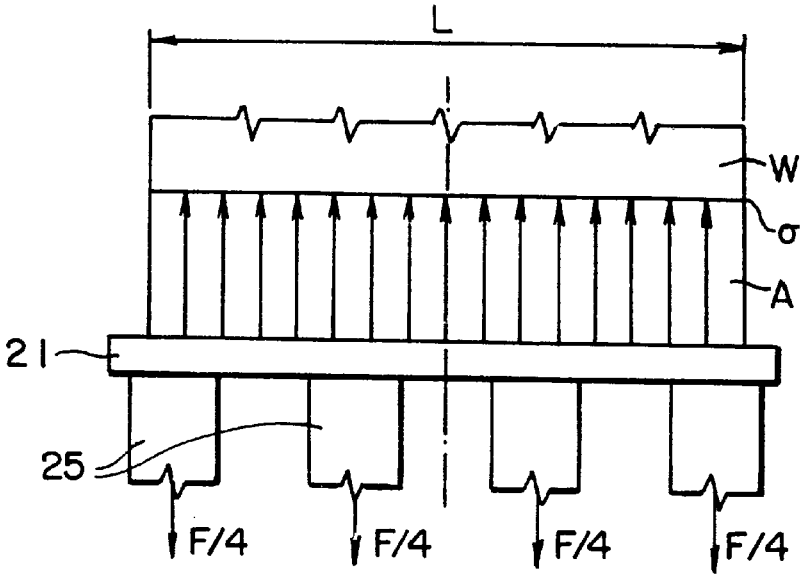
FIG. 5B is a schematic illustration of a distribution of tension that can be achieved by means of an arrangement in accordance with the present invention.

FIGS. 5A and 5B illustrate the distribution of tension produced in a web of full width by means of a threading bar drawn in two different ways. In FIG. 5B, there is a uniform tension $\sigma$ and in FIG. 5A there is an increasing tension towards the edges of the web when the threading bar 21 is drawn from its ends only (as in the prior art). The distribution of tension denoted by the dashed line in FIG. 5A has been simplified into triangular form, in which case it is easy to calculate the magnitude of the peak tension $k\cdot\sigma$ a at the edges of the web. Since, in both cases, the draw force is the same F, the areas of the distributions of tension must be the same. The area of the distribution of tension as shown in FIG. 5A is $$2\cdot\frac{k\cdot\sigma\cdot L/4}{2}=k\cdot\sigma\cdot\frac{L}{4}$$

and the area of the distribution of tension as shown in FIG. 5B is $\sigma\cdot$ L, whereby $$k\cdot\sigma\cdot\frac{L}{4}=\sigma\cdot L\Rightarrow k=4$$

Accordingly, from FIGS. 5A and 5B, it is noticed that the tension peaks produced by a threading bar 21 drawn from its ends only (FIG. 5A) are four times as high as the uniform tension produced by a threading bar 21 in accordance with the invention (FIG. 5B). It follows from this that the maximal tension must be lower than the tension resulting in tear of the web, and so, with the arrangement of FIG. 5A, the total draw force F is allowed to be just one quarter of the draw force in the arrangement of FIG. 5B, for which reason the middle portion of the web remains very slack.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A method for threading a paper web through a winding machine, the web being unwound from a paper reel and having a width, comprising the steps of:

attaching an initial end of the web to a threading member which extends over substantially the entire width of the web, coupling at least one draw fabric to the threading member, guiding the at least one draw fabric and thus the threading member through the winding machine while the web is attached to the threading member, and controlling tension of the web by controlling the draw tension of the at least one draw fabric as the at least one draw fabric is guided through the winding machine, wherein the threading member is an elongate threading bar and the at least one draw fabric comprises one fabric having a width substantially equal to the width of the web or a plurality of draw fabrics arranged substantially over the entire length of the threading bar.

2. The method of claim 1, further comprising the step of:

selecting the location at which the at least one draw fabric is coupled to the threading member in order to maintain a substantially uniform tension across the width of the web during threading of the web through the winding machine.

3. The method of claim 1, wherein the at least one draw fabric is situated at least partially between lateral edges of the web and is guided through the winding machine by drawing the at least one draw fabric in a path through the winding machine by attaching an end of the at least one draw fabric to a winding shaft about which the at least one draw fabric is wound and rotating the winding shaft by means of a drive gear.

4. The method of claim 3, wherein the tension of the web is controlled by unwinding the web from the paper reel at a substantially constant speed and regulating the drive gear to control the rotation of the winding shaft.

5. The method of claim 3, wherein the draw tension of the at least one draw fabric is controlled by measuring the draw tension and regulating the drive gear to control the rotation of the winding shaft by means of a logic system in compliance with a target tension value and the measured tension of the at least one draw fabric.

6. The method of claim 1, wherein said attaching step comprises the step of attaching the end of the paper web to the threading member by means of fastening equipment.

7. A winding device for winding a paper web including an unwind stand in which a paper reel is unwound to provide the paper web, comprising a threading member extending substantially over the entire width of the web, an initial end of the web being attached to said threading member during threading of the web through the winding device, at least one draw fabric connected to said threading member, said at least one draw fabric being directed through the winding device such that said threading member and the web attached to said threading member are guided through the winding device, and control means for controlling tension of the web by measuring and controlling draw tension of said at least one draw fabric as said at least one draw fabric is directed through the winding device, wherein said at least one draw fabric comprises one fabric having a width substantially equal to the width of the web or a plurality of draw fabrics, each being situated at least partially between lateral edges of the web and such that said draw fabrics extend over substantially over the entire width of the web.

8. The device of claim 7, wherein said control means comprise a winding shaft about which said at least one draw fabric is wound and a drive gear for controlling rotation of said winding shaft and thus the draw tension of said at least one draw fabric.

9. The device of claim 7, further comprises fastening means for attaching the initial end of the web to said threading member.

10. The device of claim 9, wherein said fastening means comprises a press-member for attaching the initial end of the web to said threading member at a location apart from an initial edge of the web and a blade for cutting off a portion of the web between the location at which the web is attached to said threading member and the initial edge of the web.

11. The device of claim 9, wherein said threading member is a threading bar, said fastening means comprising a clamp arranged on said threading member for receiving the initial end of the web.

12. The device of claim 11, further comprising an actuator connected to said clamp for opening said clamp.

13. The device of claim 7, wherein said threading member is guided to a winding part at a conclusion of the guiding of said threading member through the winding device, further comprising transfer means for transferring said threading member from said winding part to the unwind stand into a position to receive the initial end of the web.

14. The device of claim 13, wherein said transfer means comprise a chain track connected to ends of said threading member.

15. The winding device of claim 7, further comprising a guide roll over which the paper web is drawn, a suction roll movable between a first position in which it engages the paper reel and receives an initial edge of the web and a second position in which the paper web on the suction roll engages said guide roll, and fastening means for attaching the initial end of the web to said threading member while said suction roll is in said second position.

16. The device of claim 15, wherein said fastening means comprise cutting means for cutting the web between a location at which the initial end of the web is attached to said threading member and the initial edge of the web.

17. The device of claim 16, wherein said threading member is a threading bar, said fastening means comprising a clamp arranged on said threading member for receiving the initial end of the web.

18. The device of claim 15, wherein said fastening means comprises a press-member for attaching the initial end of the web to said threading member at a location apart from the initial edge of the web and a blade for cutting off a portion of the web between the location at which the web is attached to said threading member and the initial edge of the web.

* * * * *